US007160185B1

(12) United States Patent
Gemmer

(10) Patent No.: US 7,160,185 B1
(45) Date of Patent: Jan. 9, 2007

(54) AIR TRANSFER APPARATUS

(76) Inventor: Bradley Keith Gemmer, 242-52249 Range Road 233, Sherwood Park, Alberta (CA) T8B 1C7

( * ) Notice: Subject to any disclaimer, the term of this patent is extended or adjusted under 35 U.S.C. 154(b) by 176 days.

(21) Appl. No.: 10/726,058

(22) Filed: Dec. 2, 2003

(30) Foreign Application Priority Data

Dec. 2, 2002 (CA) ..... 2413294

(51) Int. Cl.
*F24F 13/18* (2006.01)

(52) U.S. Cl. ..... 454/195; 454/110; 169/91

(58) Field of Classification Search ..... 454/195, 454/200, 205, 208, 209, 210; 169/91; 55/385.2; 16/382, 383, 387; 49/504, 505; 52/204.1, 52/204.56, 217
See application file for complete search history.

(56) References Cited

U.S. PATENT DOCUMENTS

| | | | | |
|---|---|---|---|---|
| 2,420,123 | A | 5/1947 | Cooper | |
| 2,566,630 | A | 9/1951 | Powers | |
| 3,804,156 | A | 4/1974 | McDonough | 165/27 |
| 4,031,665 | A * | 6/1977 | Abramson | 49/501 |
| 4,095,440 | A * | 6/1978 | Brown et al. | 62/450 |
| 4,157,201 | A * | 6/1979 | Collins et al. | 296/156 |
| 4,286,508 | A | 9/1981 | Seebo, II | 98/43 |
| 4,326,453 | A | 4/1982 | LaBoda et al. | 98/87 |
| 4,412,478 | A | 11/1983 | Osher et al. | 98/33 |
| 4,433,985 | A | 2/1984 | McGee | 55/217 |
| 4,449,393 | A * | 5/1984 | Tucker et al. | 73/40 |
| 4,773,310 | A * | 9/1988 | Corwin | 454/244 |
| 5,187,950 | A | 2/1993 | Weldon | 62/449 |
| 5,194,039 | A | 3/1993 | Hellman, Jr. | 454/195 |
| 5,350,338 | A | 9/1994 | Hellman, Jr. | 454/195 |
| 5,370,576 | A * | 12/1994 | Krofchalk | 454/143 |
| 6,193,602 | B1 * | 2/2001 | Aprea | 454/208 |
| 6,216,402 | B1 * | 4/2001 | Van de Laar | 52/217 |
| 6,319,116 | B1 * | 11/2001 | Behl | 454/187 |
| 6,383,241 | B1 * | 5/2002 | Janus et al. | 55/385.2 |
| 2004/0110460 | A1 * | 6/2004 | Schulze et al. | 454/253 |

FOREIGN PATENT DOCUMENTS

| | | |
|---|---|---|
| DE | 3124545 | 6/1981 |
| DE | 3683367 | 2/1992 |
| EP | 649970 | 9/1994 |
| JP | 04100729 A * | 4/1992 |
| WO | 9739289 | 10/1997 |

* cited by examiner

*Primary Examiner*—Gregory Wilson
(74) *Attorney, Agent, or Firm*—Christensen O'Connor Johnson Kindness PLLC

(57) ABSTRACT

An air transfer apparatus which includes a door frame having a top, a bottom and opposed sides. The top, bottom and opposed sides define a door receiving cavity. A door is positioned within the door receiving cavity. The door is pivotally mounted to one of the opposed sides of the door frame for pivotal movement between an open and a closed position. The door has a first face and a second face. At least one fan is positioned in the door. The fan is adapted to either move air from the first face to the second face or from the second face to the first face. Preferably, the door is manufactured so it can be mounted with either side to the left or right and either end at the top or the bottom, so as to accommodate any conceivable installation.

9 Claims, 3 Drawing Sheets

AIR TRANSFER APPARATUS

FIELD OF THE INVENTION

The present invention relates to an apparatus used to force replacement of stagnant air. It is to be used in applications in which a fan is only able to create air movement within a room, but is not able to force replacement of the air.

BACKGROUND OF THE INVENTION

There are many situations in which it is desirable to replace hot, humid, polluted, or stale air within a building. Sometimes air replacement is desirable for the comfort of the occupants, such as when a building that does not have air conditioning is oppressively hot. Sometimes air replacement is desirable for the health and safety of the occupants, such as when an activity is being carried out which creates fumes.

One would normally use a fan to create air movement. Fans are relatively inexpensive and are available in a variety of sizes, so as to meet most needs. However, fans only cause air movement, not replacement. Air will just circulate within the limits of the fan. Furthermore, in the workplace, a fan positioned in a travel area such as a doorway or a hallway would interfere with the normal operation of businesses by blocking ingress and egress.

SUMMARY OF THE INVENTION

What is required is an air transfer apparatus capable of providing forced air movement and replacement, without blocking travel areas.

According to the present invention there is provided an air transfer apparatus which includes a door frame having a top, two opposed sides and a bottom. The top, opposed sides and bottom define a door receiving cavity. A door is positioned within the door receiving cavity. The door is pivotally mounted to one of the opposed sides of the door frame for pivotal movement between an open and a closed position. The door has a first face and a second face. At least one fan is positioned in the door. The fan is adapted to either move air from the first face to the second face or from the second face to the first face.

The air transfer apparatus, as described above, can be placed in a doorway to force air into or out of a room. The fan or fans used to effect air replacement are imbedded in a door and, as such, do not restrict normal travel. Persons wishing to pass by, merely pivot the "door" in the air transfer apparatus from the closed position to the open position, as they would any other door.

Although beneficial results may be obtained through the use of the air transfer apparatus, as described above, the more fans there are the greater the air flow. It is, therefore, preferred that more than one fan be provided. It is viewed as being advantageous at times to have at least one fan moving air from the first face to the second face and at least one fan moving air from the second face to the first face.

Although beneficial results may be obtained through the use of the air transfer apparatus, as described above, another application for this apparatus is in halls or corridors. Even more beneficial results may, therefore, be provided when the frame is expandable. Expanding to close the entire corridor or hallway increases efficiency. The frame may be expandable at the top, at the sides or both.

There are various ways in which an expansion assembly may be constructed. There will hereinafter be illustrated and described an expansion assembly which includes at least one pressure member selectively movable toward and away from the selected one of the opposed sides of the door frame or the top or bottom of the door frame. There is at least one male coupling on one of the pressure member or the selected one of the opposed sides of the door frame and at least one female coupling on the other of the pressure member or the selected one of the opposed sides of the door. The male coupling and the female coupling are matingly engaged. Means are provided to maintain the male coupling and the female coupling in an extended telescopic position. It is preferred that a spring be positioned-within the female coupling. The spring serves to bias the male coupling into the extended telescopic position. There are, of course, other types of expansion assemblies which can be used such as scissors expansion assembly. Where pressure members are provided it is preferred that any air gaps be closed with an accordion shield positioned between the pressure members.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
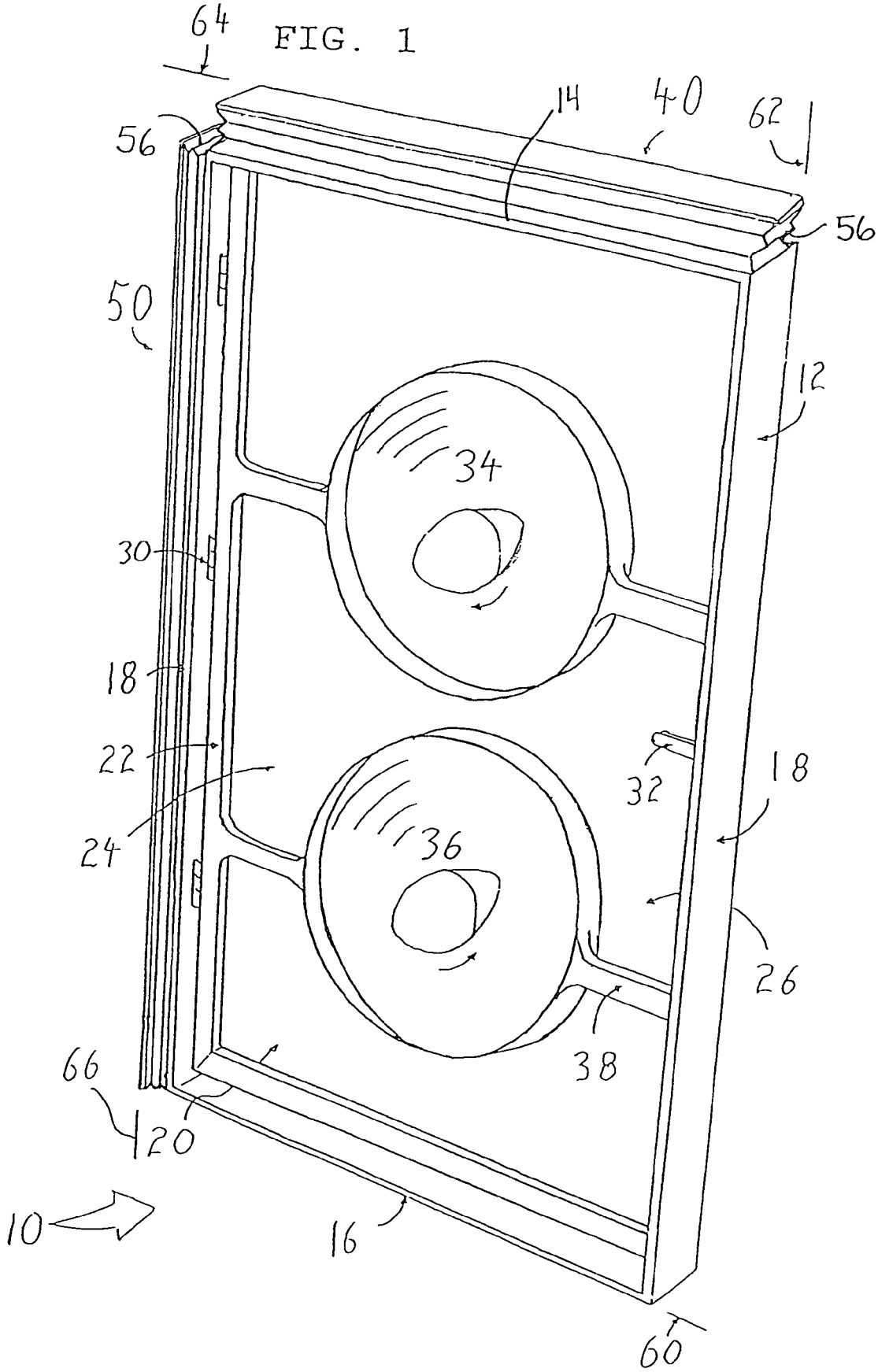
FIG. 1 is a perspective view of a preferred embodiment of air transfer apparatus constructed in accordance with the teachings of the present invention.

The preferred embodiment of air transfer apparatus, generally identified by reference numeral 10, will be described with reference to FIGS. 1 and 2. An alternative embodiment of air transfer apparatus, generally identified by reference numeral 100 will be described with reference to FIG. 3.

Structure and Relationship of Parts:

Referring to FIG. 1, air transfer apparatus 10 includes a door frame 12 having a top 14, a bottom 16 and opposed sides 18. Door frame 12 defines a door receiving cavity 20. A door 22 having a first face 24 and a second face 26, is positioned within the door receiving cavity 20. The door 22 is provided with pivotal mounts 30 and is attached to one of the opposed sides 18 of the door frame 12 allowing pivotal movement between open and closed positions. Opposite pivotal mounts 30, door 22 is further adapted with latching assembly 32. It will be appreciated that the position of door 12 could be managed by other methods or, in the alternative, be free swinging with only a detent position aligned with the door frame 12. At least one fan 34 is embedded in the door 22. In the illustrated embodiment, one fan 34 is adapted to move air from the first face 24 to the second face 26 and one fan 36, also embedded in door 22, is adapted to move air from the second face 26 to the first face 24. Both at fan 34 and fan 36 are positioned by fan supports 38. It will be appreciated that either fan 34, fan 36 or both could both be reversible, the direction of air flow in each case being at the discretion of the user/occupants.

Figure 2:
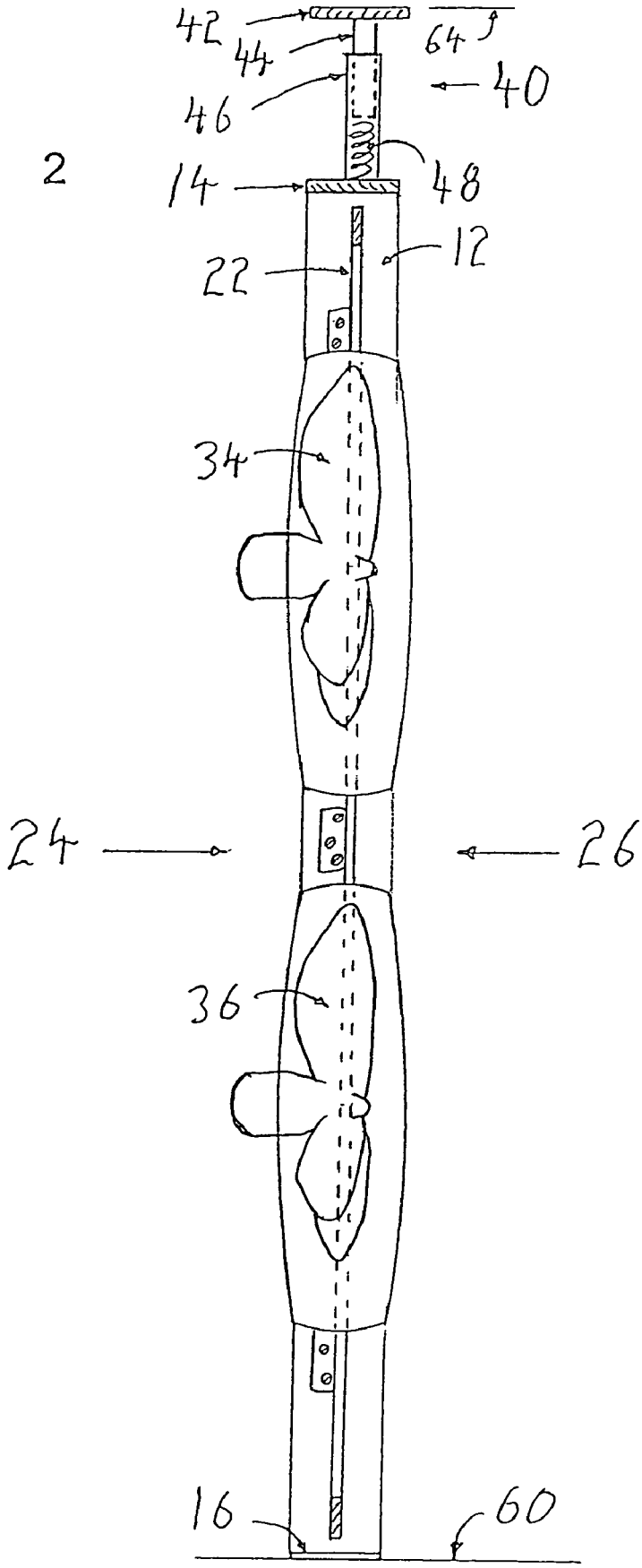
FIG. 2 is a side edge elevation view, in section, of the air transfer apparatus illustrated in FIG. 1.

Referring to FIG. 2, door frame 12 is adapted with top expansion assembly 40. Top expansion assembly 40 is adapted with a pressure member 42, male coupling 44 which is telescopically oriented with female coupling 46. Female coupling 46 is further adapted with spring 48 biasing the top expansion assembly 40 to an expanded position. Referring to FIG. 1, a similarly constructed side expansion assembly 50 is adapted to at least one of opposed sides 18.

Figure 3:
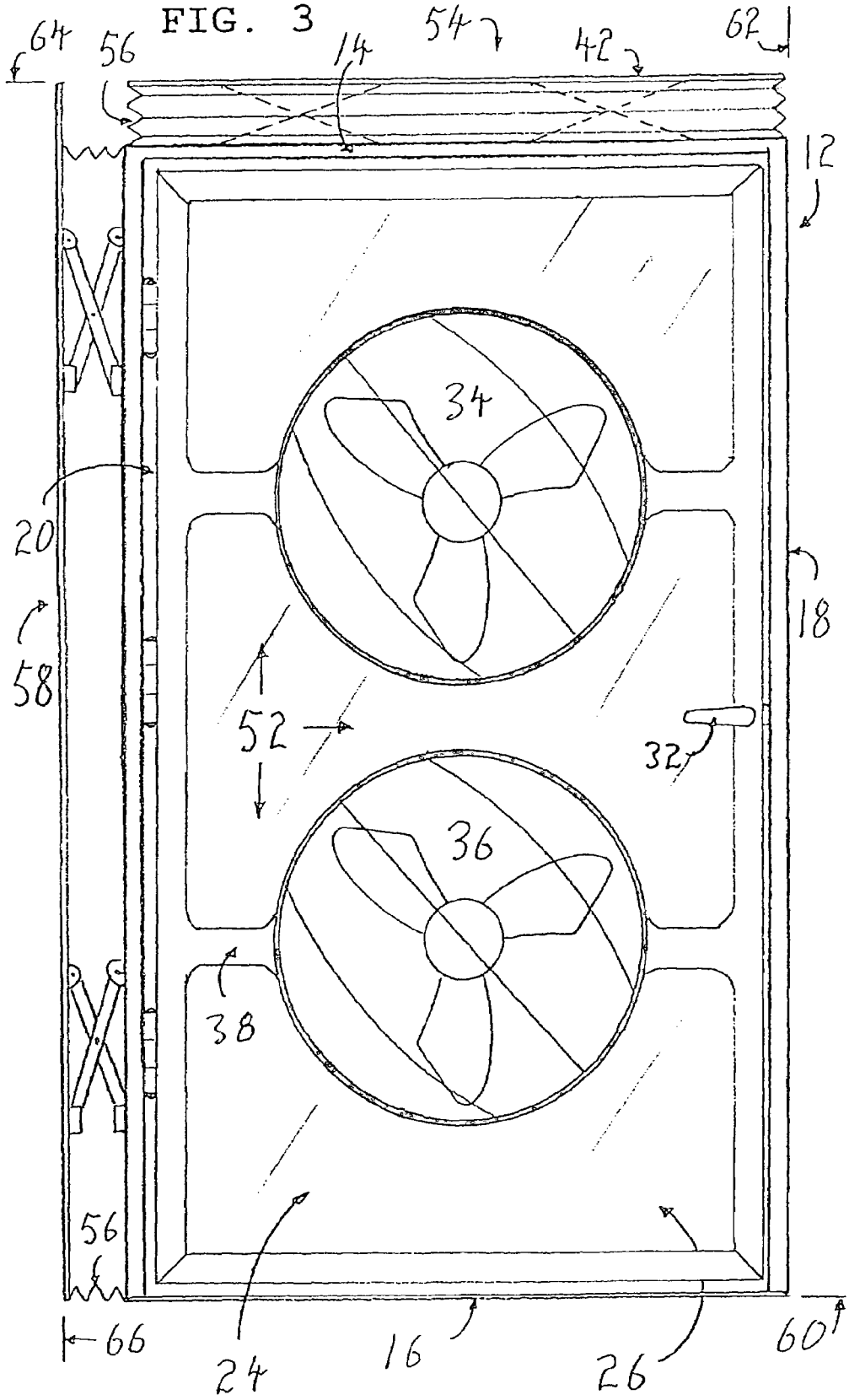
FIG. 3 is a front elevation view of an alternative embodiment of air transfer apparatus constructed in accordance with the teachings of the present invention.

Referring to FIG. 3, alternative embodiment 100 is shown with door 22 adapted in large part with transparent plexiglass 52. It will be appreciated that other transparent adaptations may be used. A top scissors expansion assembly 54 having an accordion shield 56 positioned between pressure member 42 and door frame 12. A side scissors expansion assembly 58 shown in section is similarly adapted with an accordion shield 56. It will be appreciated that other means of expansion could be used. Accordion shield 56 provides an air seal, so that air does not bypass embodiment 100.

Operation:

The use and operation of air transfer apparatus generally identified by reference numeral 10 and air transfer apparatus generally referred to by reference numeral 100 will now be described with reference to FIGS. 1 through 3. Users may selectively position air transfer apparatus 10 and air transfer apparatus 100 in doorways or corridors. Fan 34 and fan 36 may both move air in the same direction from face 24 to face 26 or face 26 to face 24. Alternatively, if the need is to create an exchange of stale air for fresh air, the user may reverse fan 34 or fan 36 and have air moving in both directions: one flow aloft and one flow below. In order to ensure that the apparatus fits the doorway or corridor, top expansion assembly 40 or top expansion assembly 54 may then be positioned and aligned with upper surface level 64. Side expansion assembly 50 or side expansion assembly 58 may then be positioned and aligned with opposite wall position 66. As users approach the door 22 at first face 24 or second face 26, they may view through transparent plexiglass 52, operate latching assembly 32 or an alternative detent, and safely pass through door receiving cavity 20. The shield 56, prevents air from bypassing the air transfer apparatus.

It is preferred that the air transfer apparatus be manufactured so that it can be mounted with either side to the left or right. It is preferred that the air transfer apparatus be manufactured so that it can be mounted with either end forming the top and either end forming the bottom. This allows for maximum versatility and accommodates any conceivable installation.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The invention claimed is:

1. An air transfer apparatus, comprising:

a door frame having a top, a bottom and opposed sides, the top, bottom and opposed sides defining a door receiving cavity configured to permit persons to walk through the door receiving cavity;

a door positioned within the door receiving cavity, the door being pivotally mounted to one of the opposed sides of the door frame for pivotal movement between an open and a closed position, the door having a first face and a second face;

at least one fan positioned in the door and adapted to move air from the first face to the second face;

the door frame having an expansion assembly which is expandable to accommodate different sizes of openings without altering the size of the door receiving cavity or interfering with the functioning of the door positioned in the door receiving cavity; and a shield being provided to stop air movement around the frame when the expansion assembly is expanded.

2. The air transfer apparatus as defined in claim 1, wherein there is more than one fan.

3. The air transfer apparatus as defined in claim 2, wherein there is at least one fan moving air from the first face to the second face and at least one fan moving air from the second face to the first face.

4. The air transfer apparatus as defined in claim 1, wherein there is no material difference between the top and the bottom, the frame being capable of being rotated prior to installation in order to position the pivotal mounting for the door to either side and the frame being capable of being inverted prior to installation in order to have the door opening either inward or outward.

5. The air transfer apparatus as defined in claim 1, wherein the expansion assembly includes at least one pressure member selectively movable toward and away from the selected one of the opposed sides of the door frame, at least one male coupling on one of the pressure member or the selected one of the opposed sides of the door frame and at least one female coupling on the other of the pressure member or the selected one of the opposed sides of the door, the at least one male coupling and the at least one female coupling being matingly engaged, means being provided to maintain the male coupling and the female coupling in an extended telescopic position.

6. The air transfer apparatus as defined in claim 5, wherein a spring is positioned within the female coupling, the spring biasing the male coupling into the extended telescopic position.

7. The air transfer apparatus as defined in claim 1, wherein the top of the frame is expandable to accommodate different heights of openings.

8. The air transfer apparatus as defined in claim 1, wherein the door is one of transparent or translucent material, thereby facilitating viewing of persons and objects through the door.

9. An air transfer apparatus, comprising:

a door frame having a top, a bottom and opposed sides, the top, bottom and opposed sides defining a door receiving cavity configured to permit persons to walk through the door receiving cavity;

a door positioned within the door receiving cavity, the door being pivotally mounted to one of the opposed sides of the door frame for pivotal movement between an open and a closed position, the door having a first face and a second face;

at least one fan positioned in the door and adapted to move air from the first face to the second face;

the door frame having an expansion assembly which is expandable to accommodate different sizes of openings without altering the size of the door receiving cavity or interfering with the functioning of the door positioned in the door receiving cavity; and a shield being provided to stop air movement around the frame when the expansion assembly is expanded;

wherein the expansion assembly is a scissors expansion assembly.

* * * * *